US009950820B2

(12) United States Patent
Futase

(10) Patent No.: US 9,950,820 B2
(45) Date of Patent: Apr. 24, 2018

(54) METHOD FOR FILLING AND PACKING GAS AND LIQUID MATERIAL

(71) Applicant: YUSHIN CO., LTD., Niigata (JP)

(72) Inventor: Katsunori Futase, Niigata (JP)

(73) Assignee: YUSHIN CO., LTD., Niigata (JP)

( * ) Notice: Subject to any disclaimer, the term of this patent is extended or adjusted under 35 U.S.C. 154(b) by 392 days.

(21) Appl. No.: 14/889,017

(22) PCT Filed: Jan. 22, 2015

(86) PCT No.: PCT/JP2015/051594
§ 371 (c)(1),
(2) Date: Nov. 4, 2015

(87) PCT Pub. No.: WO2015/186373
PCT Pub. Date: Dec. 10, 2015

(65) Prior Publication Data

US 2016/0214748 A1 Jul. 28, 2016

(51) Int. Cl.
*B65B 31/00* (2006.01)
*B65B 9/08* (2012.01)
(Continued)

(52) U.S. Cl.
CPC ..... *B65B 31/00* (2013.01); *B65B 7/02* (2013.01); *B65B 9/06* (2013.01); *B65B 9/08* (2013.01);
(Continued)

(58) Field of Classification Search
CPC .. B65B 31/00; B65B 9/08; B65B 7/02; B65B 51/10; B65B 31/045; B65B 55/00;
(Continued)

(56) References Cited

U.S. PATENT DOCUMENTS 6,237,347 B1 * 5/2001 Rigby ..... F17C 5/02 137/2
6,387,324 B1 * 5/2002 Patterson ..... A61M 1/1698 128/DIG. 3
(Continued)

FOREIGN PATENT DOCUMENTS

CN 1062877 7/1992
EP 2484229 8/2012
(Continued)

OTHER PUBLICATIONS

International Preliminary Report on Patentability for PCT/JP2015/051594, dated Jul. 25, 2017, with English language translation.
(Continued)

*Primary Examiner* — David Walczak
(74) *Attorney, Agent, or Firm* — Greenblum & Bernstein, P.L.C.

(57) ABSTRACT

A method for filling and packing a gas and a liquid material by filling the gas in an amount corresponding to 2-40 vol % of the volume of the liquid material together with the liquid material into a package bag composed of plastic films through an unsealed opening portion thereof and then sealing the unsealed opening portion by heat sealing, characterized in that the gas is previously dispersed and incorporated in form of microbubbles having a diameter of not more than 50 μm in to the liquid material and filled into in the package bag at a state of microbubble-containing liquid material, or the gas is filled while generating as microbubbles having a diameter of not more than 50 μm in the liquid material previously supplied to the package bag.

7 Claims, 4 Drawing Sheets

(51) Int. Cl.

| | |
|---|---|
| ***B65B 7/02*** | (2006.01) |
| ***B65D 75/58*** | (2006.01) |
| ***B65B 51/10*** | (2006.01) |
| ***B65B 31/04*** | (2006.01) |
| ***B65B 55/00*** | (2006.01) |
| ***B65B 61/18*** | (2006.01) |
| ***B65B 9/06*** | (2012.01) |
| *B65B 51/30* | (2006.01) |

(52) U.S. Cl.
CPC ..... *B65B 31/045* (2013.01); *B65B 51/10* (2013.01); *B65B 55/00* (2013.01); *B65B 61/186* (2013.01); *B65D 75/5883* (2013.01); *B65B 51/306* (2013.01)

(58) Field of Classification Search
CPC ..... B65B 61/186; B65B 9/06; B65B 51/306; B65B 31/02; B65B 31/022; B65B 31/04; B65B 31/024; B65D 75/5883; B65D 75/5861; B65D 75/5872
See application file for complete search history.

(56) References Cited

U.S. PATENT DOCUMENTS

| | | | |
|---|---|---|---|
| 2011/0272060 | A1 | 11/2011 | Clusserath |
| 2013/0259989 | A1 | 10/2013 | Nakamura |
| 2014/0076457 | A1 | 3/2014 | Murray |

FOREIGN PATENT DOCUMENTS

| | | |
|---|---|---|
| FR | 1402724 | 6/1965 |
| JP | 01-153410 | 6/1989 |
| JP | 02-27202 | 6/1990 |
| JP | 10-211901 | 8/1998 |
| JP | 2001-328601 | 11/2001 |
| JP | 2005-15029 | 1/2005 |
| JP | 2005-59958 | 3/2005 |
| JP | 2011-004884 | 1/2011 |
| JP | 2015-6928 | 1/2015 |
| KR | 10-2013-0114252 | 10/2013 |
| TW | 200800035 | 1/2008 |
| WO | 2013/150590 | 10/2013 |

OTHER PUBLICATIONS

Search Report issued in European Patent Office (EPO) Patent Application No. 15803681.4, dated Mar. 28, 2017.
International Search Report in PCT/JP2015/051594, dated May 19, 2015.
Office Action issued in China Counterpart Patent Appl. No. 201580001187.X, dated Apr. 21, 2017.
Office Action issued in Republic of Korea Counterpart Patent Appl. No. 10-2015-7034068, dated Sep. 13, 2017.
Office Action issued in Taiwan Counterpart Patent Appl. No. 104102907, dated Sep. 20, 2016.

* cited by examiner

METHOD FOR FILLING AND PACKING GAS AND LIQUID MATERIAL

TECHNICAL FIELD

The present invention relates to a method for filling and packing a liquid material and a gas such as inert gas, sterile gas and so on into a package bag without entraining ambient air, and more particularly to a method for filling them automatically.

BACKGROUND ART

In a package body comprised of a laminate plastic film for package filling and packing a liquid material, there is a fear that if ambient air (air), dust and so on are enclosed together with a liquid packed material into the package body, the liquid packed material is oxidized in the bag to deteriorate taste of the liquid packed material or fungi might grow in the bag. Therefore, as a method for filling the liquid packed material into the package bag without allowing invasion of air or the like are used a method of replacing air in the bag with nitrogen after the filling of the liquid packed material (Patent Document 1) and a sealing method wherein the liquid packed material is fully filled in the package bag and then subjected to a lateral sealing at this state while pushing the extra packed material with a lateral sealing roller (hereinafter referred to as "in-liquid seal packing", Patent Document 2).

In the method disclosed in the Patent Document 1, however, when nitrogen gas is injected into the package bag, there is a high possibility that air and dusts are caught in the package bag or the liquid packed material due to the injection and remain therein as they are, and hence it is impossible to encapsulate only the desired gas into the package bag. Therefore, this method has problems that facilities become large-scale for making an atmosphere in a whole of a room placing a filling-packing machine into a nitrogen gas atmosphere or the like and the amount of the gas used becomes large and the cost becomes higher.

In the method disclosed in the Patent Document 2, it is possible to fill the liquid packed material without allowing invasion of air or the like, but there is a fear that if it is intended to fill, for example, nitrogen gas, carbon dioxide gas or the like together with the liquid packed material, such a gas rises to an upper part of the liquid packed material and hence the necessary amounts of the gas and the liquid packed material cannot be filled exactly in the package bag. According to this method, the gas is easily caught in a seal portion and expanded by heating with a heat seal roller to form big bubbles to thereby cause blisters, and hence it is feared to cause the breakage of the seal portion, the leakage of the packed material and so on.

In recent years are proposed package bags provided with a pouring nozzle having a one-way function in which invasion of air or the like into the package bag not only in the filling of the liquid packed material but also after the opening of the package bag and hence oxidation, pollution or the like of the liquid packed material is suppressed over a long duration (Patent Documents 3 and 4).

In such a package bag, since the pouring port has the one-way function, ambient air is never taken into the package bag even if the liquid packed material is poured repeatedly. Accordingly, the package bag main body is shrunk and deformed associated with the pouring of the liquid packed material at only a volume corresponding to the amount of the packed material poured. In such a package bag, therefore, when the remaining amount of the liquid packed material in the package bag is large, laminate films for packing in the package bag main body are separated sufficiently widely in front and rear directions under an action of a big water head pressure of the liquid packed material by tilting the package bag body to open a pouring path relatively quickly, whereby the liquid packed material can be poured smoothly through the opened tip of the pouring nozzle. However, when the remaining amount of the liquid packed material is decreased to not more than about ⅓ of the initial amount in such a package bag, the front and rear laminate films for packing are adhered tightly to each other associated with the shrinkage or deformation of the package bag main body and hence the free flow of the liquid packed material is inhibited in the package bag. Furthermore, in case of filling a liquid packed material such as a dressing, which is necessary to be squeezed initially in use, it is required to squeeze out the package body itself, and hence quick pouring becomes impossible. In this method, therefore, a time lag to the pouring of the liquid packed material through the opened tip of the pouring nozzle becomes large and it is difficult to pour the full remaining amount of the liquid packed material in the shrunk package bag.

As a method for relieving the adhesion force between the front and rear laminate plastic films in the package bag main body, it is preferable to encapsulate an inert gas not affecting the liquid packed material such as nitrogen gas, argon gas and so on or other gas together with the liquid packed material into the package bag. In the methods disclosed in Patent Documents 1 and 2, however, it is difficult to fill both of the required amount of the liquid packed material and the gas into the package bag without allowing invasion of ambient air.

PRIOR ART DOCUMENTS

Patent Documents

Patent Document 1: JP-A-2001-328601
Patent Document 2: JP-A-H01-153410
Patent Document 3: JP-A-2005-15029
Patent Document 4: JP-A-2005-59958

SUMMARY OF THE INVENTION

Task to be Solved by the Invention

It is, therefore, an object of the present invention to solve the above-mentioned problems inherent to the prior arts and to propose a method for filling and packing a gas and a liquid material, which is capable of accurately filling a given amount of the liquid material and a given amount of the gas into a package bag while perfectly preventing invasion of ambient air and also preventing stay (biting) of the gas and the liquid material in a seal portion.

Solution for Task

In order to achieve the above object, the present invention proposes a method for filling and packing a gas and a liquid material by filling the gas in an amount corresponding to 2-40 vol % of the volume of the liquid material together with the liquid material into a package bag composed of plastic films through an unsealed opening portion thereof and then sealing the unsealed opening portion by heat sealing, characterized in that the gas is previously dispersed and incorporated in form of microbubbles having a diameter of not more than 50 μm in to the liquid material and filled into in the package bag at a state of microbubble-containing liquid material, or the gas is filled while generating as microbubbles having a diameter of not more than 50 μm in the liquid material previously supplied to the package bag.

A preferable solution means of the present invention is as follows:

(1) the liquid material is liquid or viscous food and drink, flavoring, chemical goods, cosmetics or medicines;

(2) the gas is an inert gas consisting of at least one of nitrogen gas, carbon dioxide gas and argon gas, or an active gas of at least one of oxygen and diluted air;

(3) the gas and the liquid material are continuously and airtightly filled into the package bag through the unsealed opening portion of the package bag, while the unsealed opening portion is sandwiched between a pair of heat seal rollers and heat-sealed while squeezing out the gas and the liquid material from a heat seal portion;

(4) the package bag has a vertically long shape in its up and down directions as a usage pattern and is formed by subjecting free end portions of a center-folded plastic film constituting a short side, top sealed portion of the package bag to vertical sealing to form a cylindrical body, and then performing lateral sealing at constant intervals in the vertical direction of the cylindrical body to form side sealed portions constituting long sides of the package bag while filling the gas and the liquid material into the cylindrical body;

(5) the package bag comprises a package bag main body and a film-shaped one-way pouring nozzle formed by fusion-joining mutually overlapped front and rear soft laminated films to the main body at their peripheral portions other than a base end side thereof to define a pouring path in a central portion thereof and having a self-seal function, wherein an outer surface of the base end side of the one-way pouring nozzle is fusion-joined to an inner surface of the top portion of the package bag main body to protrude the one-way pouring nozzle obliquely upward from a top sealed portion of the package bag main body; and (6) the package bag is a dripping type package bag comprising a package bag main body and a film-shaped pouring nozzle provided with a tapered pouring path at its top portion and having a self-seal function.

Effect of the Invention

According to the present invention, the required amount of the gas can be exactly filled in the package bag together with the liquid material while preventing invasion of ambient air by previously dispersing and incorporating into the liquid material as microbubbles having a diameter of not more than 50 μm and then filling into the package bag at a state of microbubble-containing liquid material or by generating and filling the gas as microbubbles having a diameter of not more than 50 μm in the liquid material previously supplied to the package bag.

Since the gas is at a state of dispersing into the liquid material as microbubbles having a diameter of not more than 50 μm, when the package bag is heat-sealed by a pair of heat seal rollers while filling the gas and the liquid material therein, the gas is too small and is squeezed out by the heat seal rollers together with the liquid material, whereby the stay (biting) of the bubbles or the liquid material in the sealed portion is never caused.

According to the present invention, even if the gas and the liquid material are filled by in-liquid seal packing with an automatic filling machine, the floating of the gas made from microbubbles can be delayed than the filling of the liquid material by utilizing a relative speed difference between the floating speed of the microbubbles and the filling speed of the liquid material, so the required amount of the gas can be surely enclosed in the package bag.

Since the gas of microbubble form filled in the package bag together with the liquid material rises up gradually under flotation and finally accumulates in an upper portion of the liquid material, even if the pouring port of the package bag has the one-way function of preventing invasion of ambient air into the package bag, because the gas accumulated in the upper portion of the liquid material reduces the adhesion force between the front and rear plastic films constituting the package bag main body to largely separate and displace the front-side plastic film from the rear-side plastic film, while the gas induces (displaces) the flowing of the liquid material into the resulting occupation space in the pouring of the liquid material from the package bag, whereby the effect of smoothly pouring of the liquid material can be produced.

When the package bag is provided with the film-shaped one-way pouring nozzle having the self-seal function, the gas is filled and packed into the package bag at a state of dispersing into the liquid material in microbubble form of less than 50 μm, so that there is no fear of deforming (permanent setting) the pouring path in an expanding direction due to invasion of the gas into the film-shaped one-way pouring nozzle in the filling-packing process and in the initial filling period. As a result, even if the gas is injected into the package bag, the front and rear plastic films constituting the film-shaped one-way pouring nozzle remain in a flat state and can develop the one-way function of the pouring nozzle effectively without inhibiting the mutual adhesion between the inner surfaces of the pouring path. After the filling and pouring of the liquid packed material, the inner surfaces of the pouring path in the film-shaped one-way pouring nozzle are strongly adhered mutually under an intervention of a thin film made of the liquid packed material, so that even if the gas rises up from the liquid material, the pouring path is protected from the invasion of the gas and hence the one-way function might not be inhibited.

Also, when a length of the fusion joint portion corresponding to the top portion of the package bag formed by the vertical sealing mechanism is shorter than a length of the fusion joint portion corresponding to each of the side portions of the package bag formed intermittently by the lateral sealing mechanism, the manufacture of the package body becomes more efficient as compared to the prior art that the length of the fusion joint portion formed by the vertical sealing mechanism is long. In this case, the fusion joint portion corresponding to the top portion of the package bag at the use form is made in the running direction (feeding direction of the film), so that more package bodies can be manufactured within a short time. According to these package bags, the liquid packed material can be filled and packed by heat sealing through the lateral sealing mechanism before the microbubbles dispersed in the liquid material rise up and are aggregated together, so that the required amount of the gas can be filled into the package bag surely and there is no fear of catching the gas in the seal portion.

EMBODIMENTS FOR CARRYING OUT THE INVENTION

Hereinafter, an embodiment of the present invention will be described with reference to the drawings.

Figure 1:
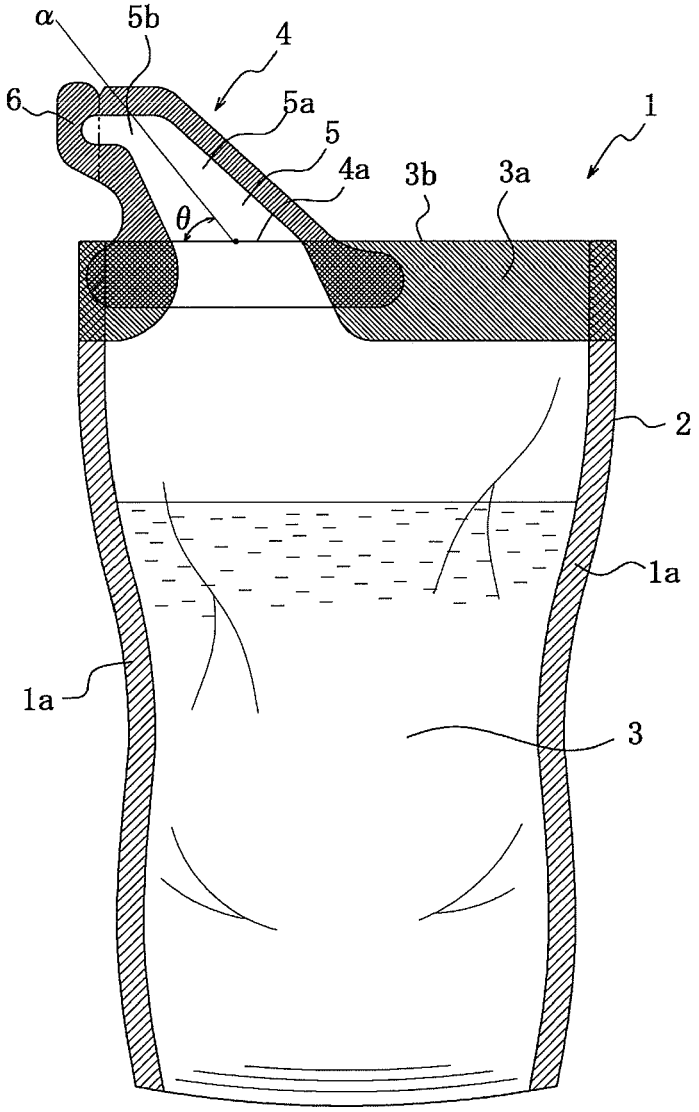
FIG. 1 is a perspective view showing an embodiment of a package body formed by the present invention at a standing position.

A package body 1 having no independence nor formability shown in FIG. 1 is formed by filling and packing a liquid material of a liquidus or viscous form such as food and drink, flavoring, medicines, cosmetics, chemical products and so on in a package bag 2. The package bag 2 comprises a flexible package bag main body 3 and a film-shaped pouring nozzle 4 having a self-seal type one-way function. The package body 1 of the present invention has a vertically long rectangle shape that a ratio of a length of a side seal portion 1*a* and a length of a top seal portion 3*a* in the package bag main body 3 (side seal portion 1*a*/top seal portion 3*a*) is preferably 2 or more.

The package bag main body 3 is made of a laminate film for packing with a laminate structure of, for example, two or more than three layers comprising a uniaxially or biaxially oriented thermoplastic base film layer and a sealant layer in which the opposed inner sealant films are fusion-joined to each other excluding a bottom portion in the figure. In the illustrated example, the bottom portion corresponds to a folded portion of the laminate film for packing, so that the illustrated package body 1 is a three-way sealed structure.

The package body 1 of this embodiment is constructed with the package bag main body 3 and the film-shaped pouring nozzle 4, but the filling and packing method of the present invention is not limited thereto. A package bag capable of filling and packing a liquid material by in-liquid seal packing such as a three-way sealed or four-way sealed package bag, a small bag made of only a package bag main body portion, a package bag having a spout or the like can be utilized preferably.

The film-shaped pouring nozzle 4 is formed by fusion joining a single flat soft laminate film at a folded state or two flat soft laminate films at a state of overlapping the opposed sealant layers in their peripheral portions excluding a base end side to define a pouring path 5 in its central portion. The film-shaped pouring nozzle 4 is fusion joined at a top seal portion 3*a* of the package bag main body 3 shown by diagonal lines in the figure wherein the pouring path 5 is communicated to the inside of the package bag main body 3.

In the film-shaped pouring nozzle 4, a fusion joining portion 6 of its tip is removed by tearing to open the pouring path 5, whereby the pouring of the liquid material from the package bag main body 3 can be performed through collapsing deformation of the package bag main body 3 without sucking ambient air into the package bag main body 3. On the other hand, when the pouring from the package body 1 is stopped under displacement of the package bag main body 3 to its standing posture, the inner surfaces of the pouring path 5 in the film-shaped pouring nozzle 4 is closed immediately under the intervention of the thin film of the liquid packed material associated with wetting caused by capillary action or the like of the liquid packed material, whereby the self-seal function of preventing invasion of ambient air into the package bag main body 3 can be produced.

That is, when the film-shaped pouring nozzle 4 further pours the liquid packed material from the package bag, the package bag main body 3 is tilted so as to direct the film-shaped pouring nozzle 4 downward to open the pouring path 5 of the pouring nozzle 4 through hydraulic head pressure or the like of the liquid material in the package bag, whereby the liquid packed material in the package bag can be poured as necessary. After the pouring of the liquid packed material from the package bag, the tip opening of the film-shaped pouring nozzle 4 is automatically closed by the self-seal function, so that there is no fear of penetrating ambient air into the package body 1 through the film-shaped pouring nozzle 4 even if the liquid packed material is poured repeatedly from the package bag.

In this embodiment of the package bag 2, the film-shaped pouring nozzle 4 is protruded obliquely upward from the top seal portion 3*a* of the package bag main body 3 by fusion-joining the sealant layer located on the outer surface of the base end portion of the film-shaped pouring nozzle 4 to the sealant layer located on the inner surface of the package bag main body 3.

The film-shaped pouring nozzle 4 in this embodiment comprises an inclination portion 5*a* protruding obliquely upward from the upper edge 3*b* of the package bag main body 3 at the base end side 4*a* and a horizontal portion 5*b* extending to the free end portion side of the inclination portion 5*a* inclusive of a tear-opening portion and being parallel to the upper edge 3*b* of the package bag main body 3.

The upward inclination angle of the film-shaped pouring nozzle 4 defined by an angle θ between a center line a of the pouring path in the width direction of the inclination portion 5*a* and the upper edge 3*b* of the package bag main body 3 is set to a range of 25-70°, preferably 40-60°. When the angle θ is set to the above range, the occurrence of the liquid dropping can be prevented more effectively.

When the inclination angle θ is less than 25°, the tip opening 8 of the film-shaped pouring nozzle 4 is too close to the upper edge 3*b* of the package bag main body 3, and hence there is a feat that the poured liquid material adheres to the package bag main body 3 or the liquid material cannot be poured toward the desired direction. On the other hand, when the inclination angle θ exceeds 70°, the package body 1 must be tilted largely in the pouring of the liquid material, and hence the liquid material in the package body 1 flows into the pouring path 5 of the film-shaped pouring nozzle 4 at once, so that there is a fear that the pouring amount cannot be controlled or the liquid material cannot be poured toward the desired direction and the surroundings are contaminated due to the splashing and so on of the liquid material.

Figure 2:
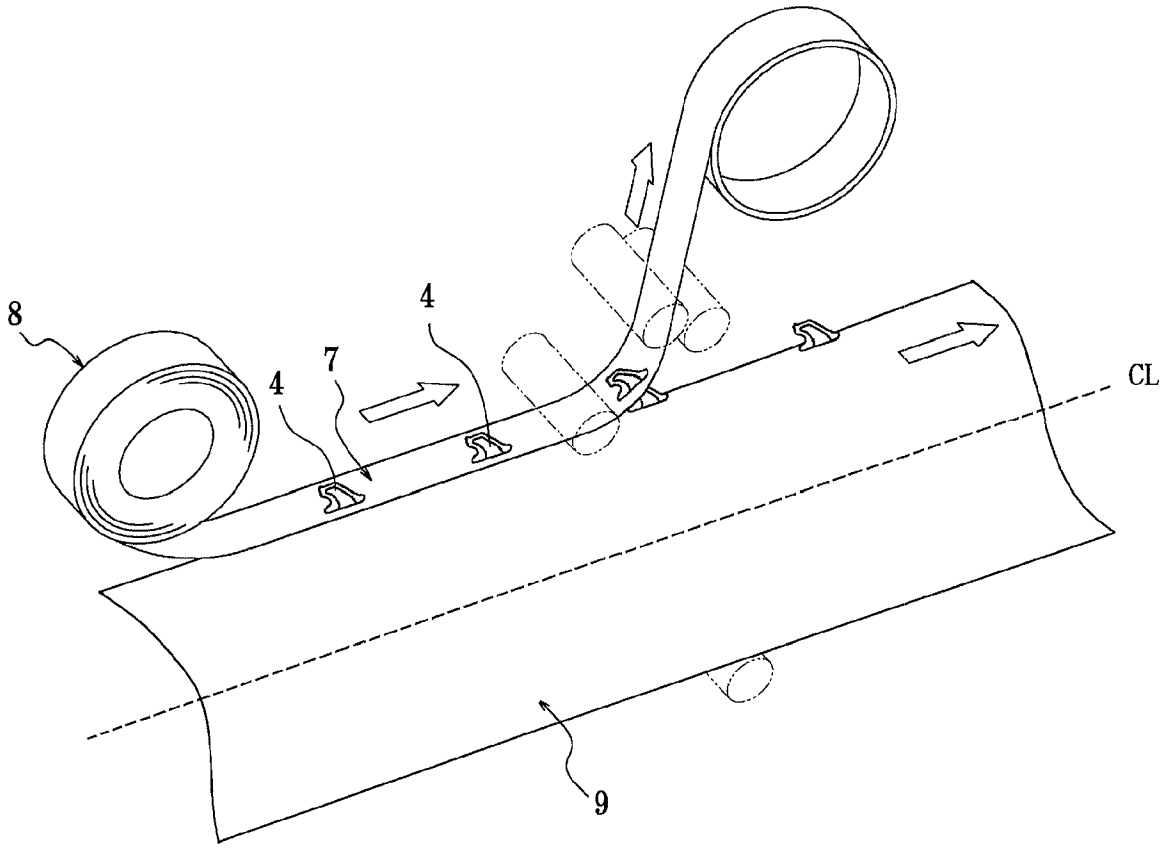
FIG. 2 is a perspective view showing a method of attaching a one-way pouring nozzle to a package bag main body.

In the package body 1, as a method of attaching the one-way pouring nozzle 4 to the package bag main body 3 and a method of producing the package bag can be used, for example, the device similar to that disclosed in JP-A-2008-55739 as shown in FIG. 2 and the existing bag-manufacturing machine.

In FIG. 2, a nozzle film 7 previously provided with numerous film-shaped pouring nozzles 4 is fed, for example, from a winding roll 8 thereof to a film 9 for the package bag main body running continuously or intermittently at the desired speed, preferably continuously, and one of the sealant layers on the outer surface of the base end portion of each one-way pouring nozzle 4 is fusion-joined to the sealant layer on the inner surface of the film 9 for the package bag main body under the running of the both films 7, 9 at a constant speed. Moreover, the unnecessary portion of the nozzle film 7 is cut out and removed from the film-shaped pouring nozzle 4. Subsequently, the film 9 for the package bag main body fusion-joined to the film-shaped pouring nozzle 4 is fed to an automatic filling machine, for example, shown in FIG. 3.

Figure 3:
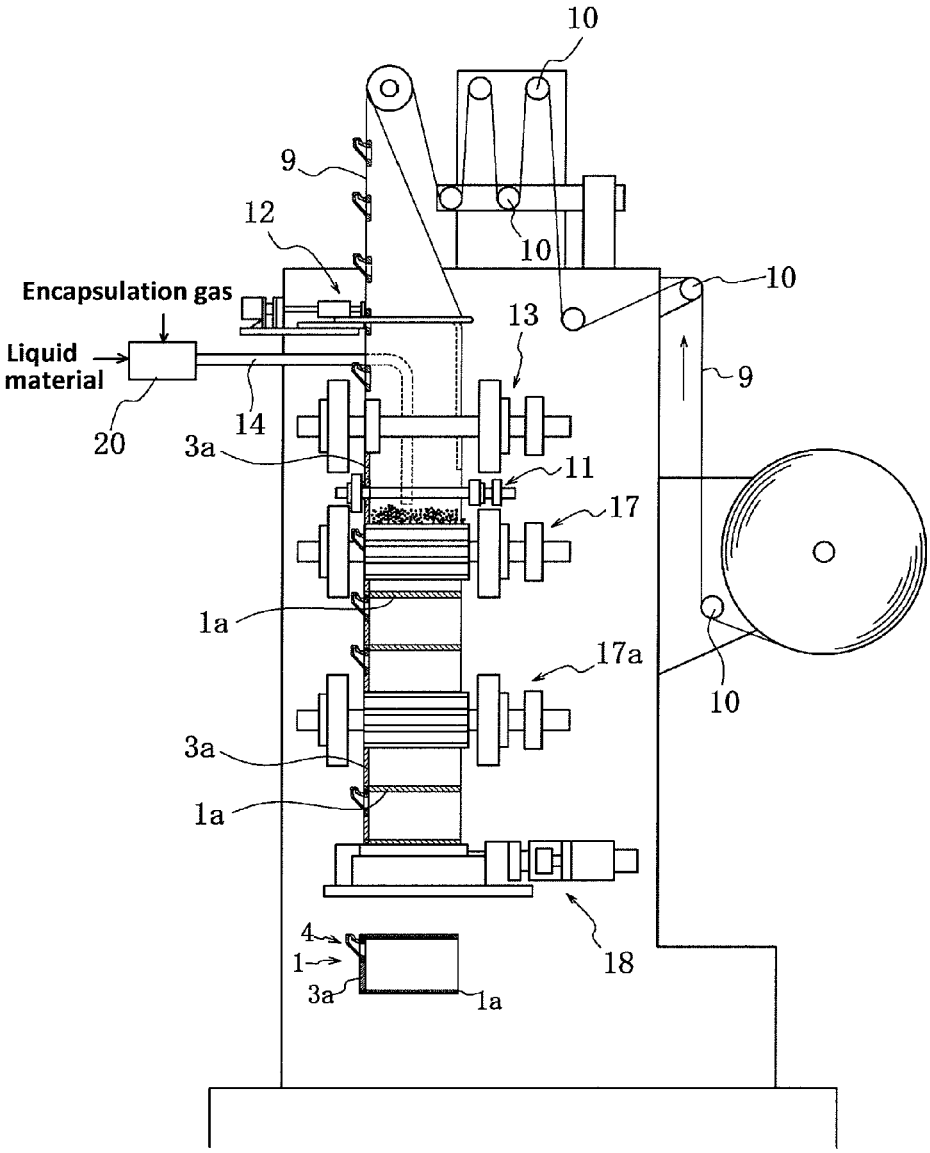
FIG. 3 is a front view showing an embodiment of an automatically filling device for filling and packing a liquid material by the method according to the present invention.

The automatic filling machine comprises plural guide rollers 10 guiding the running of the film 9 for the package bag main body intermittently or continuously fed from the winding roll, a film folding portion 12 center-folding the film 9 for the package bag main body passed through the guide rollers 10 in the widthwise direction so as to face the sealant layers to each other, a vertical sealing mechanism 13 forming a fusion-joined portion in the vertical direction, for example, continuously in each free end portion of the film 9 for the package bag main body folded by the film folding portion 12, a filling nozzle 14 in FIG. 3 as a filling means for intermittently or continuously filling the liquid packed material to an inside of a tubular film 9 for the package bag main body formed with the fusion-joined portion (top seal portion 3*a*), and a lateral sealing mechanism 17 forming a lateral fusion-joined portion in the tubular film 9 for the package bag main body filled with the liquid packed material.

In addition, the automatic filling machine can manufacture the package body 1 by forming lateral fusion-joined portions (side seal portions 1*a*) while squeezing out the liquid material through the lateral sealing mechanism 17 (a pair of lateral heat sealing rollers) (in-liquid seal filling) to fill the liquid material into the package bag while preventing invasion of ambient air.

In addition to the above, the illustrated automatic filling machine comprises a second lateral sealing mechanism 17*a* again sandwiching the fusion-joined portions 1*a* formed by the lateral sealing mechanism 17 composed of the pair of lateral seal rollers and functioning to enhance the fusion-joint strength thereof; and a cutter means 18 cutting and separating continuous package bodies 1 manufactured intermittently or continuously every one or every predetermined plural ones.

In such a package body 1, when an inert gas having no influence on the liquid material such as nitrogen gas, carbonate gas or the like and a gas having bacteriostatic or sterile effect are encapsulated in an amount of 2-40 vol % of the filling amount (volume) of the liquid packed material in the packed material (hereinafter referred as a "encapsulation gas"), the encapsulation gas can produce an effect of preventing declination of the liquid material in the bag, while when the pouring port (film-shaped pouring nozzle 4 in FIG. 3) has, for example, the one-way function, the encapsulation gas accumulated above the liquid material can weaken and separate the adhesion force based on the one-way function between the mutually front and rear laminate plastic films for the package bag main body 3. Further, the encapsulation gas can guide (replace) the flowing of the liquid material into the occupied space thereof in the pouring of the liquid material from the package body 1 and enables the smooth pouring of the liquid material in the bag to the end.

In the present invention, therefore, as shown in FIG. 3, the film 9 for the package bag main body is center-folded in the widthwise direction so as to face the sealant layers to each other and the free end portions thereof are vertically sealed by the vertical sealing mechanism 13 to form a tubular body and the encapsulation gas is filled therein as microbubbles of not more than 50 μm in diameter together with the liquid material, whereby the filling and packing are performed at a state of dispersing the microbubble-like encapsulation gas in the liquid material.

Moreover, as shown in FIG. 3, the encapsulation gas and the liquid material are supplied from the filling nozzle 14 as a liquid material containing a microbubble-like gas by previously generating and dispersing microbubbles of the encapsulation gas in the liquid material with a microbubble generator 20 such as an aspirator or the like disposed at a position prior to the filling nozzle 14.

The encapsulation gas and the liquid material can be supplied while generating the encapsulation gas as the microbubbles in the liquid material filled in the tubular body through the filling nozzle 14 instead of the method shown in FIG. 3. The method for generating the microbubbles is not limited to the above. For example, the encapsulation gas is sufficiently dissolved in the liquid material under a high pressure in advance and the encapsulation gas-containing liquid material is supplied into the liquid material filled in the tubular body through the filling nozzle 14, in which the encapsulation gas is released to an atmospheric pressure and supersaturated in the liquid material to form microbubbles.

The microbubble-like encapsulation gas and the liquid material supplied in the tubular body made of the film 9 for the package bag main body as mentioned above are automatically filled into the package bag 2 while preventing invasion of ambient air by lateral-sealing the tubular body in the lateral direction while squeezing out them with the lateral sealing mechanism 17 (a pair of lateral heating seal rolls). According to this method, the microbubble-like encapsulation gas is dispersed in the liquid material as fine bubbles having a diameter of not more than 50 μm, so that it is squeezed out together with the liquid material through a pair of the lateral seal rolls and has no possibility of remaining in the heat seal portion by catching.

Now, the floating speed of the bubbles in the liquid material can be determined by the Stokes' law. For example, when the liquid material is water, it can be seen that bubbles having a diameter of 1 mm float several meters per one minute, while microbubbles having a diameter of 10 μm float only several millimeters per one minute. Therefore, if the encapsulation gas is generated in the liquid material as microbubbles of not more than 50 μm, the microbubble gas does not move (float) from the generation position during the filling into the package bag 2 and is at a state of dispersing into the liquid material with remaining small size, and hence the required amounts of the gas and the liquid material can be simultaneously filled and packed into the package bag 2 without generating bubbles in the seal portion.

Particularly, when the package bag 2 is provided with the film-shaped one-way pouring nozzle 4 having the self-seal function, the encapsulation gas does not invade into the pouring path 5 during the filling and packing of the liquid packed material, and hence the pouring path 5 might not be deformed in an expansion direction by the encapsulation gas, so that the inner surfaces of the pouring path 5 can be adhered to each other at a flat state to develop the one-way function effectively.

Also, it is preferable that as shown in FIG. 3, a pair of squeezing rolls or squeezing boards 11 are disposed at a position above the tip of the filling nozzle 14 to squeeze the tubular film 9 for the package bag main body to thereby make an interspace thereof narrow up to 1-10 mm. Thus, the filling speed of the liquid material can be adjusted, while the floating of the generated bubbles is suppressed and also the bubbles are filled into the package bag 2 along the inner surface of the film 9 for the package bag main body, whereby the floating of the bubbles can be prevented effectively.

In general, fine bubbles having a bubble diameter of not more than 50 μm at the time of generation are called as microbubbles. The normal bubbles rise in water rapidly and disappear by burst at the surface of the water, while the microbubble have a feature that they are compressed by surface tension of water, reduced and disappeared by burst in the water, and also they are dispersed uniformly in water while keeping small state because microbubbles are charged negatively at their surfaces and hardly integrated or absorbed with each other.

Moreover, the microbubble having a diameter of not more than 50 can suppress the floating and aggregation, but if they are submicroscopic bubbles of less than 1 μm (nano-bubbles), they might be stably present in water at this condition for a long period of time (over several months), and hence a long time is taken until the gas is accumulated in the upper side of the liquid material by floating of the bubbles and the effect of reducing the adhesion force between the front and rear laminate films for the package bag main body 3 as described above might not be produced. Therefore, the diameter of the bubble is more preferred to be not less than 1 μm.

The encapsulation gas is preferable to be selected in accordance with the nature of the liquid material filled in the package bag 2. When the liquid material is easily oxidized or polluted by air (for example, liquid seasoning such as soy sauce, oils, cosmetics, pharmaceuticals, etc.), it is preferable to use an inert gas such as nitrogen, carbon dioxide gas or the like, while when the quality of the liquid material is not deteriorated by contacting with a certain amount of an active gas, there may be used an active gas such as oxygen, diluted air or the like. Especially, when the package bag 2 is proved with the film-shaped pouring nozzle 4 as mentioned above, since the invasion of ambient air into the package bag is inhibited by the self-seal function of the pouring nozzle 4, the growth of aerobic bacteria in the package bag 2 can be suppressed, while since the amount of oxygen dissolved in the package bag 2 is small, there is a fear of growing anaerobic bacteria such as botulinum or clostridium perfringens. In this connection, the present invention can expect an effect of decreasing pH of the liquid material and suppressing the growth of the anaerobic bacteria effectively by filling carbon dioxide gas having a bacteriostatic effect or a mixed gas of carbon dioxide gas and nitrogen gas or the like together with the liquid material.

The filling amount of the encapsulation gas is not less than 2 vol % of the volume of the liquid material filled in the package bag 2. When the filling amount is less than 2 vol %, the aforementioned bacteriostatic effect cannot be exhibited effectively and the pouring path 5 of the film-shaped pouring nozzle 4 cannot be opened sufficiently since the adhesion force between the inner surfaces of the package bag main body 3 is not reduced. On the other hand, when the encapsulation gas is enclosed in an amount of not less than 2 vol % of the volume of the filled liquid material, the above effect can be exhibited effectively regardless of the amount of the encapsulation gas.

When the amount of the encapsulation gas is large, the filling amount of the liquid material is decreased and also there is a risk of flowing out the encapsulation gas in the pouring of the liquid material from the pouring path 5 of the film-shaped pouring nozzle 4 depending on the method of handling or using. Therefore, the upper limit of the amount of the encapsulation gas is preferable to be not more than 40 vol % of the volume of the liquid material filled in the package bag 2.

In the present invention, it is preferable to protrude the film-shaped pouring nozzle 4 diagonally upward from the top seal portion 3*a* of the package bag main body 3 as shown in FIG. 1. In this case, it is required that the package body 1 is tilted greatly so as to direct the tip opening of the film-shaped pouring nozzle 4 downward during the pouring of the liquid material as compared with a case that the film-shaped pouring nozzle 4 is protruded from the upper end portion of the side seal portion 1*a* of the package bag main body 3 (Patent Documents 3 and 4). As a result, the encapsulation gas in the package body 1 moves toward the bottom portion side of the package bag main body 3 greatly with the tilting of the package body 1, and hence the effect of decreasing the risk of flowing out the encapsulation gas with the liquid material can be expected.

In the production of the vertically long package body 1 as shown in FIG. 1, the top seal portion 3*a* where the film-shaped pouring nozzle 4 is fusion-joined is formed by the vertical sealing mechanism 13 continuously or intermittently acting to the continuously running film for the package bag main body 9 as shown in FIG. 3. Further, each of the side seal portions 1*a* corresponding to the both sides of the package body 1 is formed intermittently in a direction perpendicular to the running direction of the film 9 for the package bag main body by the lateral sealing mechanism 17 operating at a given speed independently from the vertical sealing mechanism 13 while continuously filling the liquid material into the tubular film 9 for the package bag main body shaped by the top seal portion 3*a*. Thus, the extending length of the top seal portion 3*a* is made shorter than the extending length of the side seal portion 1*a*.

Since the length of the top seal portion 3*a* formed by the vertical sealing mechanism 13 is shorter than the extending length of the each side seal portion 1*a*, the working time of the vertical sealing mechanism 13 can be shortened effectively as compared with the case of forming the side seal portion 1*a*, for example, by the vertical sealing mechanism 13. Therefore, the side seal portion 1*a* is formed by the lateral sealing mechanism 17 at a timing required for finishing the filling of the liquid material into the package bag 2, whereby the time necessary for the manufacture of the package body 1 can be shortened sufficiently to largely enhance the manufacturing efficiency of the package body 1. Also, the package body 1 can be manufactured before floating and aggregation of the microbubbles dispersed in the liquid material, so that the required amount of the encapsulation gas can be filled exactly and there is no fear of generating bubbles caused by the biting of the encapsulation gas in the side seal portion 1*a*.

Moreover, the package body 1 may be formed as a four-side sealing structure by forming a bottom seal portion extending in parallel to the top seal portion 3*a* at the bottom of the package body 1 by the vertical sealing mechanism 13.

According to the manufacturing method of the vertically long package body 1 as mentioned above, the extending length of each of the side seal portions 1*a* formed by the lateral sealing mechanism 17 is longer than the length of the top seal portion 3*a* formed by the vertical sealing mechanism 13, so that the weight of the liquid material loaded per unit length of the side seal portion 1*a* in the filling of the liquid material in the tubular-shaped film 9 for the package bag main body becomes smaller and hence there is no possibility of generating longitudinal crimps on the film 9 for the package bag main body, and the generation of pin-holes in the side seal 1*a* can be prevented.

Figure 4:
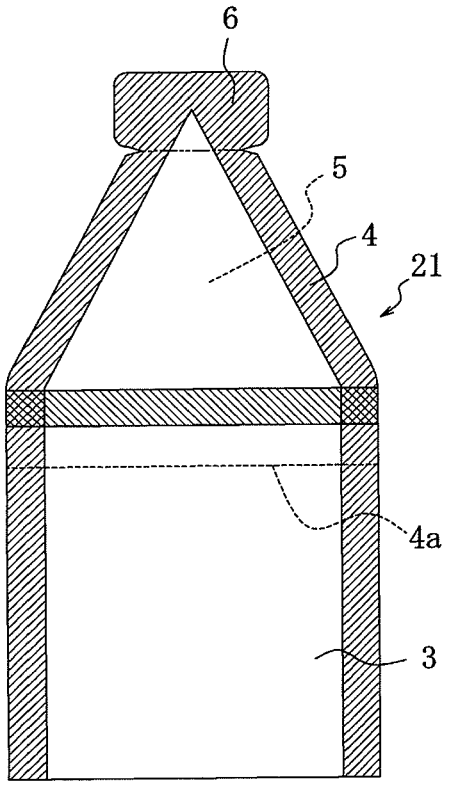
FIG. 4 is a view showing an embodiment of a dropping type package bag.

When the liquid packed material and the encapsulation gas such as carbon dioxide or the like are filled in a dropping type package bag 21 comprising the package bag main body 3 and the self-sealed type film-shaped pouring nozzle 4 provided at its upper end portion with a tapered pouring path as shown in FIG. 4 by the filling and packing method of the present invention, the liquid material in the package bag can be dropped from an opening formed by cutting the fusion-joined portion 6 at the tip of the film-shaped pouring nozzle 4 without capturing ambient air through the tilting or reversing of the dropping type package bag 21. According to the dropping type package bag 21, the liquid material can be protected sufficiently from oxidation, fungus contamination and so on for a long period of time without adding an antifouling agent or the like to the liquid material, while the growth of the anaerobic bacteria can be prevented by effectively developing the bacteriostatic effect with carbon dioxide gas or the like, whereby the safety and hygiene of the liquid material in the package bag can be improved.

The dropping type package bag 21 can be formed by fusion joining the outer surface of the base end portion 4*a* of the film-shaped pouring nozzle 4, which is provided at its central portion with the pouring path 5 defined by fusion joining the peripheral portions of the single center-folded soft laminate plastic film or two soft laminate plastic films excluding the base end portion 4*a* as shown by diagonal lines in the figure, to the inner surface of the upper portion of the package bag main body 3 composed of the laminated plastic films.

INDUSTRIAL APPLICABILITY

Although the present invention is described with reference to the illustrated embodiments, it is not limited to them and may be modified properly, if necessary. As the liquid material filled and packed in the package bag can be preferably used seasoning liquid such as soy sauce, cosmetics, medicines, foods and drinks such as hot pack food, retort food and the like, chemical products and so on.

DESCRIPTION OF REFERENCE SYMBOLS

1 package body
1*a* side seal portion
2 package bag
3 package bag main body
3*a* top seal portion
3*b* upper edge
4 film-shaped pouring nozzle
4*a* base end portion
5 pouring path
5*a* inclination portion
5*b* horizontal portion
6 fusion-joined portion
7 nozzle film
8 winding roll
9 film for the package bag main body
10 guide roll
11 squeezing roll or squeezing board
12 film folded portion
13 vertical sealing mechanism
14 filling nozzle
17 lateral sealing mechanism
17*a* second lateral sealing mechanism
18 cutting means
20 microbubble generation unit
21 dropping type package bag

The invention claimed is:

1. A method for filling and packing a gas and a liquid material by filling the gas in an amount corresponding to 2-40 vol % of the volume of the liquid material together with the liquid material into a package bag composed of plastic films through an unsealed opening portion thereof and then sealing the unsealed opening portion by heat sealing, characterized in that the gas is previously dispersed and incorporated in form of microbubbles having a diameter of not more than 50 μm in to the liquid material and filled into in the package bag at a state of microbubble-containing liquid material, or the gas is filled while generating as microbubbles having a diameter of not more than 50 μm in the liquid material previously supplied to the package bag.

2. The method for filling and packing a gas and a liquid material according to claim 1, wherein the liquid material is liquid or viscous food and drink, flavoring, chemical goods, cosmetics or medicines.

3. The method for filling and packing a gas and a liquid material according to claim 1, wherein the gas is an inert gas consisting of at least one of nitrogen gas, carbon dioxide gas and argon gas, or an active gas of at least one of oxygen and diluted air.

4. The method for filling and packing a gas and a liquid material according to claim 1, wherein the gas and the liquid material are continuously and airtightly filled into the package bag through the unsealed opening portion of the package bag, while the unsealed opening portion is sandwiched between a pair of heat seal rollers and heat-sealed while squeezing out the gas and the liquid material from a heat seal portion.

5. The method for filling and packing a gas and a liquid material according to claim 1, wherein the package bag has a vertically long shape in its up and down directions as a usage pattern and is formed by subjecting free end portions of a center-folded plastic film constituting a short side, top sealed portion of the package bag to vertical sealing to form a cylindrical body, and then performing lateral sealing at constant intervals in the vertical direction of the cylindrical body to form side sealed portions constituting long sides of the package bag while filling the gas and the liquid material into the cylindrical body.

6. The method for filling and packing a gas and a liquid material according to claim 1, wherein the package bag comprises a package bag main body and a film-shaped one-way pouring nozzle formed by fusion-joining mutually overlapped front and rear soft laminated films to the main body at their peripheral portions other than a base end side thereof to define a pouring path in a central portion thereof and having a self-seal function, wherein an outer surface of the base end side of the one-way pouring nozzle is fusion-joined to an inner surface of the top portion of the package bag main body to protrude the one-way pouring nozzle obliquely upward from a top sealed portion of the package bag main body.

7. The method for filling and packing a gas and a liquid material according to claim 1, wherein the package bag is a dripping type package bag comprising a package bag main body and a film-shaped pouring nozzle provided with a tapered pouring path at its top portion and having a self-seal function.

* * * * *